US005456472A

United States Patent [19]

Goodman

[11] Patent Number: 5,456,472

[45] Date of Patent: Oct. 10, 1995

[54] GAME APPARATUS AND METHOD OF PLAY

[76] Inventor: Benjamin I. Goodman, 685 Wedgewood Rd., Bethlehem, Pa. 18017

[21] Appl. No.: 360,981

[22] Filed: Dec. 20, 1994

[51] Int. Cl.[6] ..... A63F 3/02

[52] U.S. Cl. ..... 273/241; 273/260; 273/262; 273/284; 273/287; 273/291

[58] Field of Search ..... 273/241, 284, 273/255, 260, 261, 262, 291, 287

[56] References Cited

U.S. PATENT DOCUMENTS

| | | | |
|---|---|---|---|
| 3,692,310 | 9/1972 | Martin | 273/241 |
| 4,070,026 | 1/1978 | Cambardella | 273/254 |
| 5,085,441 | 2/1992 | Jova | 273/248 |

FOREIGN PATENT DOCUMENTS

| | | | |
|---|---|---|---|
| 224381 | 6/1987 | European Pat. Off. | 273/262 |
| 2645412 | 6/1977 | Germany | 273/241 |
| 4135598 | 5/1993 | Germany | 273/241 |

*Primary Examiner*—Benjamin H. Layno
*Attorney, Agent, or Firm*—Sanford J. Piltch

[57] ABSTRACT

A game apparatus having a game board with a plurality of sides and with multi-planar levels which are modifiable by the placing or removing of fill squares onto or from any one or more of a plurality of vertical spaces on the game board. The spaces are arranged in an edge-to-edge array across the game board. The game is played between two players with each player having an identical set of playing pieces representing characters or things in the game. The playing pieces are permitted to move along predetermined paths and capture opposing playing pieces, the movement being restricted by obstacles and different levels of the multi-planar game board.

18 Claims, 3 Drawing Sheets

FIG. 4
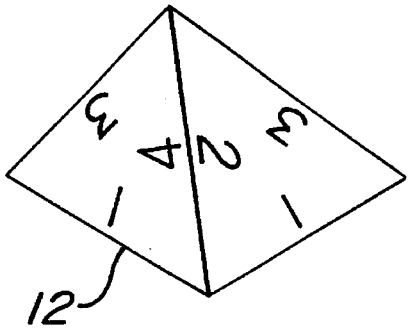
FIG. 8
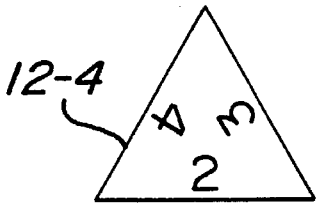
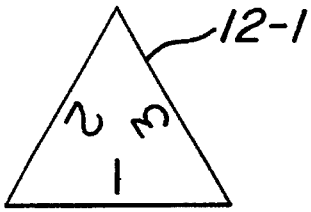
FIG. 5
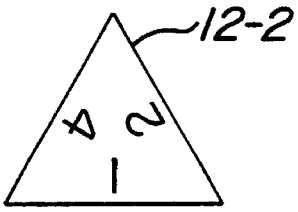
FIG. 6
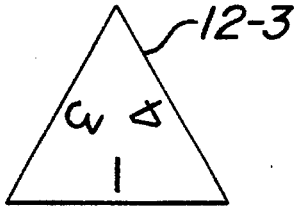
FIG. 7
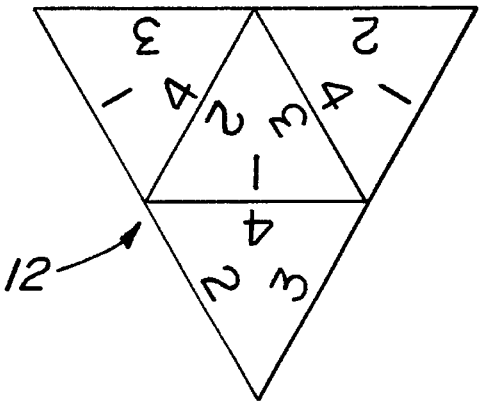
FIG. 9

GAME APPARATUS AND METHOD OF PLAY

FIELD OF THE INVENTION

This invention relates generally to board-type games and the representations of such games for play on computers.

BACKGROUND OF THE INVENTION

There are certain similarities between the layout and play of this invention and earlier board games such as Chess, Checkers and the like. However, the limitations of those games were that they are played on a single plane. These games played on a single plane lacked the challenge to the player opponents of providing additional obstacles by introducing multi-planar board levels as well as other obstacles to enhance the challenge and the level of play.

Thus, it is an object of the present invention to provide additional challenges to player opponents by presenting a board game having multi-planar levels of play, the ability to alter all or a portion of one or more of the multi-planar levels so as to provide for additional obstacles or to remove existing obstacles to the movement of the various pieces across the board.

Another object of the present invention is to provide each player opponent with the ability to so alter the multi-planar levels of the game so as to create an obstacle to player piece movement or to remove such obstacle within each player opponent's stratagem.

Another object of the present invention is to provide a unique playing field on a multi-planar board which is alterable in accordance with each player opponent's strategy.

A still further object of the present invention is to provide rules of play that can adapt to differing stratagems as each player opponent executes that player's strategy.

Other objects will become evident hereinafter.

SUMMARY OF THE INVENTION

The present invention is an apparatus for playing a game which game is comprised of a game board having a plurality of sides and multi-planar levels, a plurality of fill squares having first and second sides, each of the sides of the fill squares having a color with the color of the first side being different than the color of the second side, a plurality of playing pieces comprising identical first and second sets, the first set being of a uniform but different color than the second set, and each of the sets of playing pieces representing a series of characters and things for use in playing the game, and means for providing random numeric designations representing the side of the game board adjacent to which the first set of playing pieces are to be set out in a predetermined array.

By way of further general description, the game board is arranged so that at least two sides oppose one another, each of the sides being identified by numeric designation. The game board has at least four multi-planar levels divided into a plurality of vertical spaces arranged in an edge-to-edge array across the board, with the multi-planar levels being modifiable by the addition of one or more fill squares and the removal of one or more fill squares in one or more of the spaces as the play of the game progresses. The multi-planar levels of the game board each have a different but uniform color so as to clearly indicate the level of play in each of the spaces of the game board. The first color of the first side of each of the fill squares matches the color of the second level of play of the game board and the second color of the second side of each of the fill squares matches the color of the third level of play of the game board.

The first and second sets of playing pieces represent a series of characters and things with each comprised of an Emperor, two Towers, two Oracles, two Warriors, eight Peasants, and one Obstacle as said playing pieces. The means for providing random numeric designations is a single pyramid shaped die having a predetermined array of numeric designations on each of its faces so that the position of said die resulting from a toss reveals the side of the game board adjacent to which the first set of playing pieces are to be set out.

The game is played by two or more players by utilizing the game board having a plurality of sides and multi-planar levels, the plurality of playing pieces in each of two identical sets as described above, and the means for providing random numeric designations (the pyramid shaped die), which numeric designations represent the side of the game board adjacent to which the first set of playing pieces are to be set out in a predetermined array. The game is begun by tossing the pyramid shaped die to select the side of the game board along which the first player will place and arrange the first set of playing pieces in the predetermined array followed by the second player placing and arranging the second set of playing pieces in the same predetermined array along the side of the game board opposite the side of the game board selected by the first player. Play continues with the second player placing or removing one or more fill squares onto or from any of the one or more of a plurality of vertical spaces which are arranged in an edge-to-edge array laid out across the game board which divide the game board into the array of spaces and followed by moving any playing piece along a movement path in accordance with that playing piece's permitted movement, such movement being restricted by the levels of the multi-planar levels of the game board encountered along said playing piece's permitted movement path, to obtain an advantageous offensive or defensive position for the second player by changing the position of the moved playing piece or by capturing a playing piece of the first player.

Once the second player has completed a turn, the first player continues play by placing or removing one or more fill squares onto or from any of the one or more of a plurality of the spaces followed by moving any playing piece along a movement path in accordance with that playing piece's permitted movement, again the movement being restricted by the levels of the multi-planar levels of said game board encountered along said playing piece's permitted movement path, to obtain an advantageous offensive or defensive position for the first player by changing the position of the moved playing piece or by capturing a playing piece of the second player. The restriction of movement between levels of the multi-planar game board for each playing piece occurs if the level of the game board differs by more than one level such that a playing piece's movement path is blocked and said playing piece may not move farther along the movement path. Also, restriction of movement may be accomplished by one player placing an Obstacle playing piece along the movement path of one of the opponent's playing pieces, which Obstacle can not be captured. Play, and the game, is ended by capturing the playing piece representing the Emperor of the first or second player by one of the playing pieces of the other player.

It is contemplated that the play of the game may be in ordinary three-dimensional space on the described game board, or be played on a game board created by video imaging on a computer with the play of the game assisted by a keyboard, enhanced joystick, or other similar mechanism.

BRIEF DESCRIPTION OF THE DRAWINGS

For the purpose of illustrating the invention, forms which are presently preferred are shown in the drawings; it being understood, however, that the invention is not limited to the precise arrangements and instrumentalities shown.

FIG. 4 is an isometric view of the pyramid-shaped die.

FIG. 5 is a first face of the pyramid-shaped die.

FIG. 6 is a second face of the pyramid-shaped die.

FIG. 7 is a third face of the pyramid-shaped die.

FIG. 8 is a fourth or bottom face of the pyramid-shaped die.

FIG. 9 is the pyramid-shaped die with all faces unfolded.

DETAILED DESCRIPTION OF THE INVENTION

The following detailed description is of the best presently contemplated modes of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
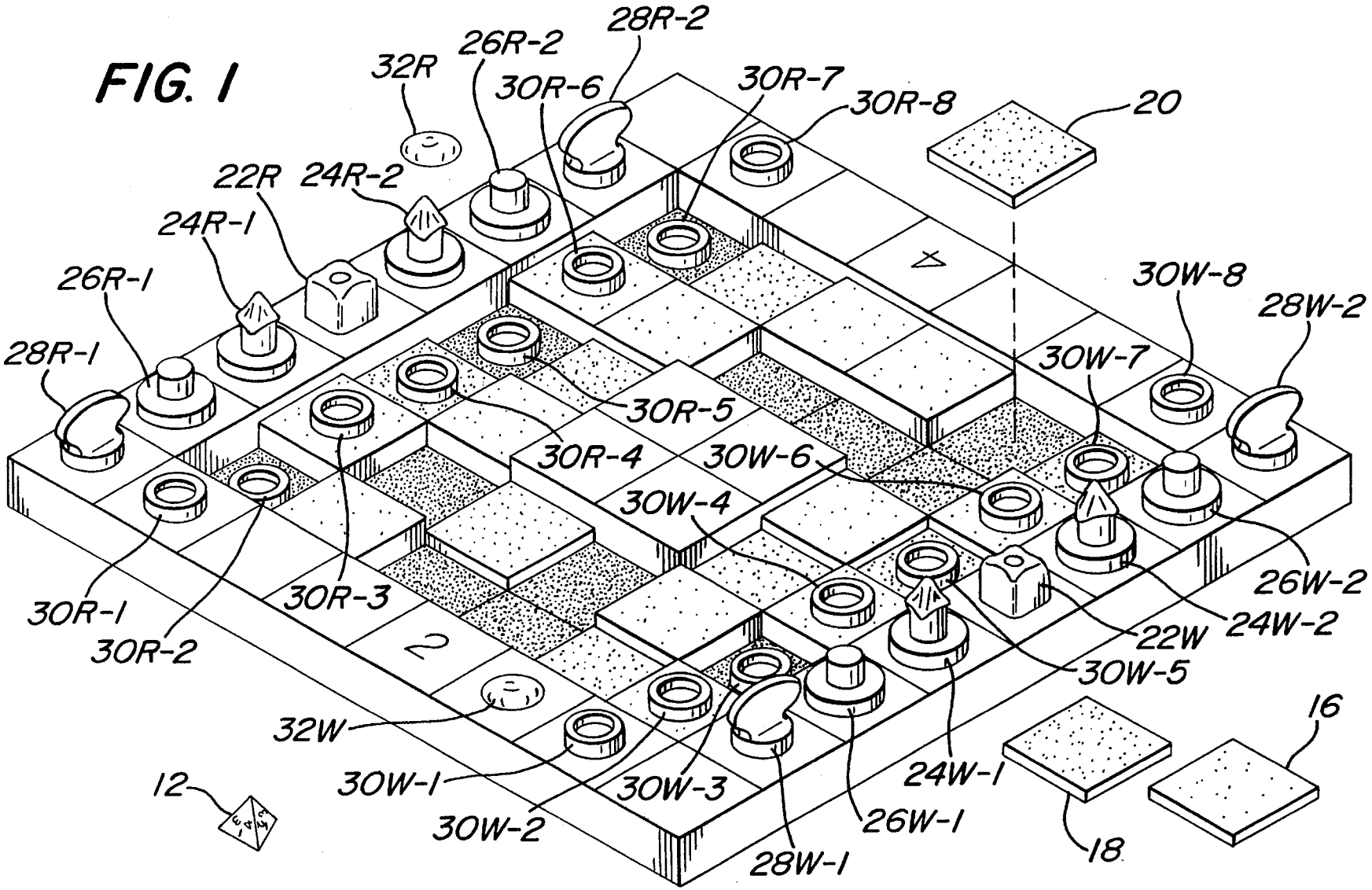
FIG. 1 is an isometric view of the game board of the present invention showing the game pieces and the pyramid-shaped die.

The drawings used herein illustrate the details of the present invention and use like numerals to indicate like elements. With reference to FIG. 1, there is shown the Stepjess game 10 comprising the pyramid-shaped die 12, the game board 14, thirty-two playing pieces (to be identified by number below), and fill squares 16, 18 and 20. Fill square 16 is shown with its Yellow side showing; fill square 18 is shown with its Green side showing; and fill square 20 is shown with its Green side showing. Each of the fill squares 16, 18 and 20 has its opposite side colored green and yellow, respectively. This coloration of the fill squares 16, 18 and 20 will be explained in connection with the coloration of the squares of the game board 14.

There are thirty-two (32) playing pieces, sixteen (16) of each of two colors, for example red and white. There are two (2) "Emperor" playing pieces 22R, 22W. There are four (4) "Tower" playing pieces 24R-1, 24R-2, 24W-1, 24W-2. There are four (4) "Oracle" playing pieces 26R-1, 26R-2, 26W-1, 26W-2. There are four (4) "Warrior" playing pieces 28R-1, 28R-2, 28W-1, 28W-2. There are sixteen (16) "Peasant" playing pieces 30R-1 through 30R-8 and 30W-1 through 30W-8. There are two (2) "Obstacle" playing pieces 32R, 32W.

Figure 2:
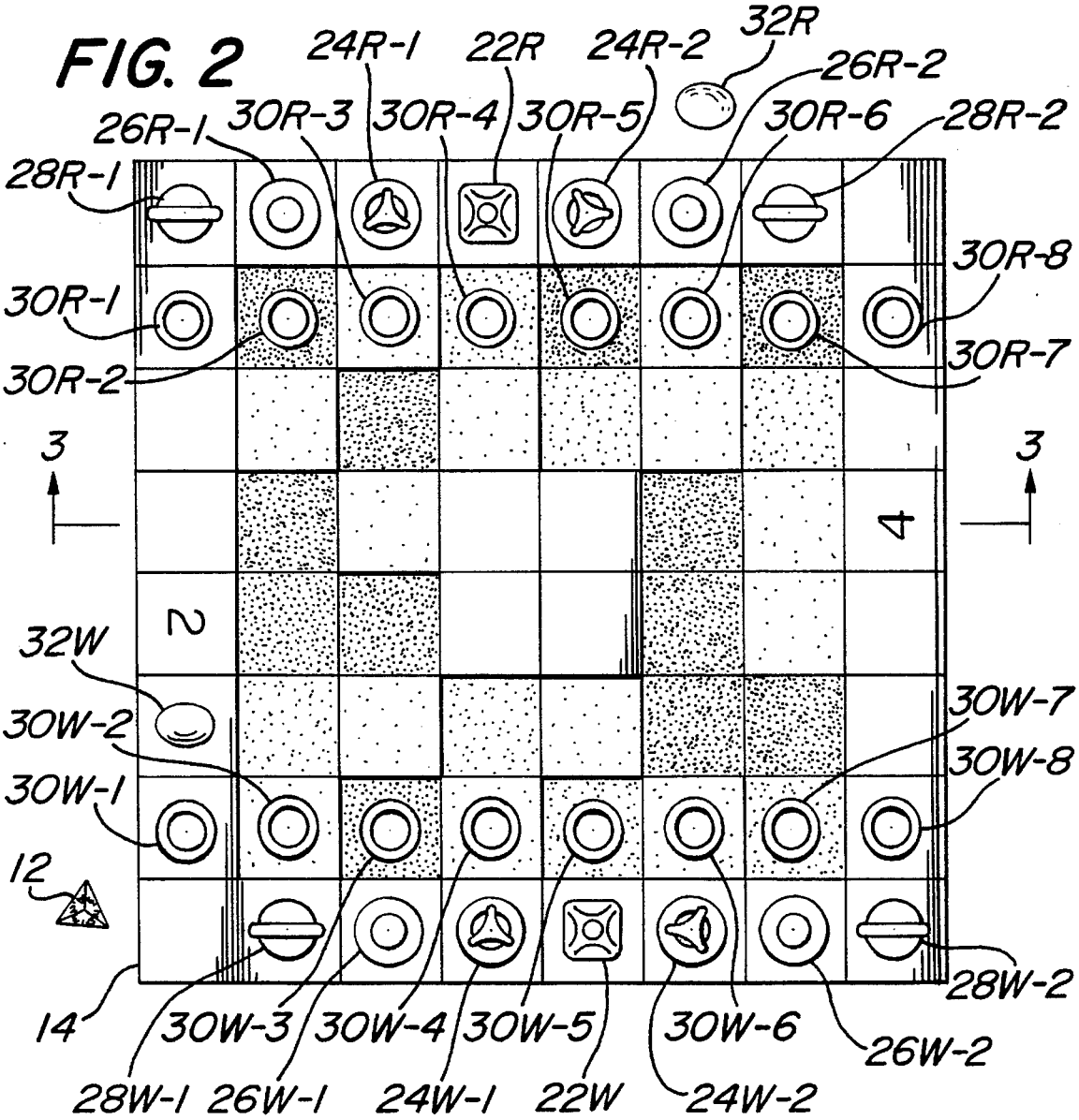
FIG. 2 is a top plan view of the game board of the present invention with the game pieces and the pyramid-shaped die.
Figure 3:
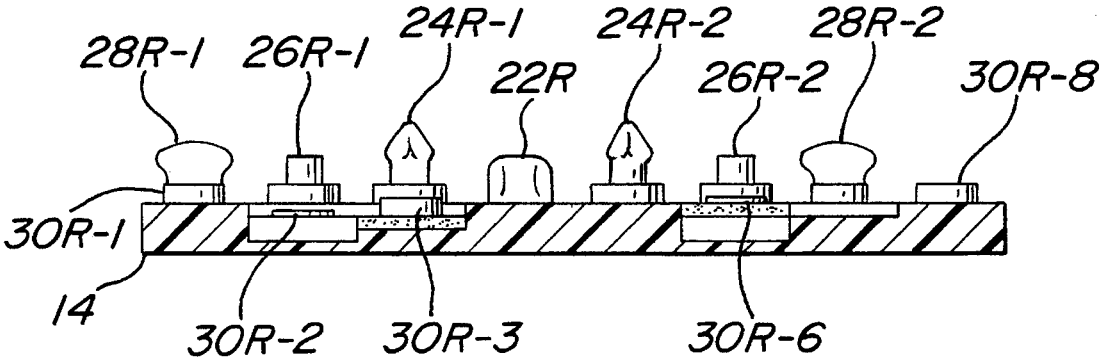
FIG. 3 is a sectional view of the present invention taken along Line 3—3 of FIG. 2.

The playing pieces are initially arrayed on the game board 14 as shown in FIGS. 1, 2 and 3. Each player opponent's Emperor, Towers, Oracles, and Warriors are arrayed in the first row of spaces of the game board 14 on the side closest to the player. This row is the White or uppermost level of the game board 14. The Peasants of each player opponent are arrayed across the second row, immediately in front of the major playing pieces, regardless of the level of the game board 14 along the second row. The Obstacle 32R is shown not to be in play while Obstacle 32W is shown positioned in the space in the row immediately in front of Peasant 30W-1.

The game board 14 is divided into a series of adjacent spaces or squares arranged into eight (8) equal rows. With eight (8) spaces or squares per row, the game board 14 has sixty-four (64) spaces or squares. The game board 14, as alluded to above, has multiple levels of play which can be altered by either player opponent. The lowest level is the Blue level, the next level is the Green level, the next level is the Yellow level, and the highest level is the White level. The outer rows of the game board 14 are all at the highest level, the White level. The internal spaces of the rows of the game board 14 are at varying levels with the colors of the levels indicated by the different shading of the spaces.

By way of example, the lowest level of the game board 14 is shaded the darkest to indicate the Blue level. The next or second level is shaded slightly lighter to indicate the Green level. The next or third level is only slightly shaded to indicate the Yellow level. The top or highest level is not shaded at all to indicate the White level. The colors of the opposite sides of the fill pieces 16, 18 and 20 are shaded similarly to the second and third levels of the game board 14 to indicate the Green or Yellow levels. The fill pieces 16, 18 and 20 can be placed over the Blue or Green spaces to raise the level of the game board 14 at that particular space.

Referring to FIG. 1, fill piece 20 (which shows a Green side facing upwards) is to be placed over a Blue space on the game board 14 to raise the level of that particular space to the second or Green level. Once a fill piece 16, 18 or 20 is placed on to a Blue or Green space, either player in any subsequent play sequence may remove such fill piece 16, 18 or 20 which returns the level of the game board 14 to the lower level at that particular space. It is also possible to build a second level of fill pieces 16, 18 or 20 on top of a first level of fill pieces 16, 18 or 20 to raise the level of that particular space from Blue to Green, and then to Yellow. The difference in the levels of the game board 14, from the lowest to the highest at the outside rows, can be seen by referring to FIG. 3. The reason for placing or removing the fill pieces 16, 18 and 20 onto or from the game board 14 will be fully described in connection with the explanation of play.

However, before describing the play, it is important to describe the pyramid-shaped die 12. With reference to FIGS. 4 through 9 the different faces of the die 12 are shown. The number which along the bottom edge of the die 12, which number will be uniformly a "1", "2", "3", or "4" will determine the side of the game board 14 which will be defended by the player opponent rolling the die 12.

The present invention, Stepjess, has been created to be a simulation of a battle on the "Great Wall of China". This is one reason for the different levels on the game board 14, to simulate a series of steps going up and down the "Wall". The object of the game is to capture the player opponent's Emperor, which concludes the game. Prior to beginning the game of Stepjess, the player opponents must agree on the number of fill squares 16, 18 and 20 which will be used during the game. The minimum number of fill pieces 16, 18 and 20 is twelve (12) such pieces and the maximum number is eighteen (18) such pieces. The game will become more difficult as the number of fill squares 16, 18 and 20 is reduced to the minimum number to be used.

To begin the game of Stepjess, the younger player opponent rolls the pyramid-shaped die 12. With reference to FIGS. 4–9 one can readily see that the die 12 has a predetermined numbering scheme which results in the same number appearing around the bottom edge of the die 12 when the die comes to rest after being thrown. Once the die 12 is rolled, the player rolling the die places the playing pieces of the color of his/her choice along the side of the game board 14 which corresponds to the number which appears along the bottom edge of the die 12 by placing the playing pieces in the array shown in FIGS. 1 and 2. The player opponent then places his/her playing pieces on the side of the game board 14 opposite his/her player opponent's playing pieces. For example, in FIG. 1 the Red playing pieces are set up on side 1 of the game board 14 and the White playing pieces are set up on the opposite side, side 3 of the game board 14.

A description of the permitted movement(s) of the various playing pieces is now warranted. The Emperor 22 is permitted to move a single space in any direction. The Tower 24 is permitted to move as many spaces as desired in a straight line; forward, backward and left or right, but not diagonally. The Oracle 26 is permitted to move as many spaces as desired, but only diagonally. The Warrior 28 is permitted to move a single space forward or backward and a single space left or right or, alternatively, to move a single space left or right and a single space forward or backward. The Peasant 30 is permitted to move a single space forward, backward or diagonally, but not left or right. The Obstacle 32 is permitted to be played only once at any point in the game to disable the space or square for the remainder of the game. No piece of either player opponent can subsequently travel over the space or square, stop on it, fill or dig that space or square.

To capture a player opponent's playing piece, the player opponent must move his/her playing piece onto the space or square occupied by the first player opponent's playing piece. If a player opponent accidentally moves his/her playing piece onto a space or square where it is not permitted, that player opponent has captured his/her own playing piece as a penalty. When a playing piece is captured, it must be removed from the game board 14.

To begin play, the player opponent who did not roll the die 12 and did not get to choose the side of the game board 14 to defend takes the first turn. Whenever it is a player opponent's turn, the following options for play can be done in the exact order presented below:

FILL or DIG (Optional)—A player may place (fill) or remove (dig) one (1) fill square 16, 18 and 20 onto or from any space or square on the game board 14. A player may only fill a Blue or Green space or square or dig a Yellow or Green square. If a player fills a Blue square, then the Green side of the fill squares 16, 18 or 20 should face upward. If a player fills a Green square, then the Yellow side of the fill squares 16, 18 or 20 should face upward. A player may choose to fill or dig two (2) fill squares 16, 18 and 20 to place on to or remove from the same space or square of the game board 14, and thereby player forfeits his/her right to move a playing piece during that turn. When the agreed number of fill squares 16, 18 and 20 (i.e. 12–18 fill squares) are placed on the game board 14, no player may fill or dig during the remainder of the game.

PLAYING PIECE MOVEMENT—Following the optional play of filling or digging, a player (who did not fill or dig two (2) fill squares 16, 18 or 20) must move one of his/her playing pieces the number of spaces or squares and along the path of movement permitted for the selected playing piece. Any playing piece may be moved along its movement path either to an empty space or square or to a space or square occupied by the player opponent's playing piece capturing such playing piece; provided that, a playing piece may only travel from one space or square to an adjoining space or square only if there is no more than one level separating the spaces or squares, e.g. playing pieces can be moved from the Blue level to the Green level, from the Green level to the Yellow level, from the Yellow level to the White level, from the White level to the Yellow level, from the Yellow Level to the Green level, or from the Green level to the Blue level, but the playing piece can not travel from the Blue level to the Yellow level, from the Green level to the White level, from the White level to the Green level, or from the Yellow level to the Blue level. If a player chooses not to fill or dig, or if the agreed number of fill squares 16, 18 and 20 are already placed on the game board 14, the player must still move a playing piece. When a player moves a playing piece, or a fill square 16, 18 or 20, and removes his/her hand, the play is completed. After a player has performed one or more of the permitted play steps his/her turn is over and play continues with his/her player opponent. Play ends with the capture of the player opponent's Emperor.

The foregoing description of play for the present invention, Stepjess, while resembling playing piece and movement description similar to chess, is quite unlike the game of chess. It is to be understood that the game can be played in a three dimensional form with each of the player opponents physically touching the playing pieces and game board 14. The game of Stepjess can also be played in a two dimensional environment by playing the game interactively on a video display terminal of a computer under program control in accordance with the rules of play set forth above.

The present invention may be embodied in other specific forms without departing from the spirit or essential attributes thereof and, accordingly, the described embodiments are to be considered in all respects as being illustrative and not restrictive, with the appended claims, rather than the foregoing description, indicating the scope of the invention as well as all modifications which may fall within a range of equivalency which are also intended to be embraced therein.

I claim:

1. Apparatus for playing a game comprising:

a game board having a plurality of sides and multi-planar levels;

a plurality of fill squares having first and second sides, each of said sides having a color, said color for said first side being different from said color for said second side;

a plurality of playing pieces comprising identical first and second sets of said playing pieces, the first set being of a uniform but different color than the second set, and each of said sets of playing pieces representing a series of characters and things for use in playing the game; and means for providing random numeric designations representing the side of the game board adjacent to which said first set of playing pieces are to be set out in a predetermined array.

2. The Apparatus of claim 1 wherein said game board being arranged so that at least two sides oppose one another, said sides being identified by numeric designation.

3. The Apparatus of claim 1 wherein said game board has at least four multi-planar levels divided into a plurality of vertical spaces arranged in an edge-to-edge array across the game board, said multi-planar levels being modifiable by the addition of one or more fill squares and the removal of one or more fill squares in one or more of said spaces.

4. The Apparatus of claim 1 wherein said first and second sets of playing pieces representing a series of characters and things each comprise an Emperor, two Towers, two Oracles, two Warriors, eight Peasants, and one Obstacle as said playing pieces.

5. The Apparatus of claim 1 wherein said means for providing random numeric designations being a pyramid shaped die having a predetermined array of numeric designations on each of its faces so that the position of said die resulting from a toss reveals the side of the game board adjacent to which said first set of playing pieces are to be set out.

6. The apparatus of claim 1 wherein each of said multi-planar levels of the game board having a different but uniform color so as to clearly indicate the level of play in each of said spaces of said game board.

7. The Apparatus of claim 6 wherein the first color of the first side of said fill squares matches the second level of play of the game board and the second color of the second side of said fill squares matches the third level of play of said game board.

8. Method for playing a game comprising the steps of:

providing a game board having a plurality of sides and multi-planar levels;

providing a plurality of playing pieces comprising identical first and second sets of said playing pieces, the first set being of a uniform but different color than the second set, and each of said sets of playing pieces representing a series of characters and things for use in playing the game;

providing means for providing random numeric designations representing the side of the game board adjacent to which said first set of playing pieces are to be set out in a predetermined array;

tossing the means for providing random numeric designations to select the side of the game board along which a first player will place and arrange said first set of playing pieces in a predetermined array;

placing and arranging said second set of playing pieces in a predetermined array by a second player along the side of the game board opposite the side of the game board selected by said first player;

placing or removing one or more fill squares onto or from any of the one or more of a plurality of vertical spaces which are arranged in an edge-to-edge array laid out across the game board and dividing said game board into said spaces by said second player followed by moving any playing piece of said second player along a movement path in accordance with said playing piece's permitted movement restricted by the levels of the multi-planar levels of said game board encountered along said playing piece's permitted movement path to obtain an advantageous offensive or defensive position for said second player by changing the position of the moved playing piece or by capturing a playing piece of said first player;

placing or removing one or more fill squares onto or from any of the one or more of a plurality of said spaces by said first player followed by moving any playing piece of said first player along a movement path in accordance with said playing piece's permitted movement restricted by the levels of the multi-planar levels of said game board encountered along said playing piece's permitted movement path to obtain an advantageous offensive or defensive position for said first player by changing the position of the moved playing piece or by capturing a playing piece of said second player; and capturing the playing piece representing the Emperor of the first or second player by one of the playing pieces of the other player.

9. The Method of claim 8 further comprising the step of providing said game board so that at least two sides oppose one another, said sides being identified by numeric designation.

10. The Method of claim 8 further comprising the step of providing said game board having at least four multi-planar levels and said plurality of spaces, said multi-planar levels being modifiable by the addition of one or more fill squares and the removal of one or more fill squares in one or more of said spaces.

11. The Method of claim 8 further comprising the step of providing first and second sets of playing pieces representing a series of characters and things, each of said first and second sets comprising an Emperor, two Towers, two Oracles, two Warriors, eight Peasants, and one Obstacle as said playing pieces.

12. The Method of claim 11 wherein each of said playing pieces has a prescribed movement along prescribed paths.

13. The Method of claim 8 wherein each of said playing pieces has a prescribed movement along prescribed paths.

14. The Method of claim 8 further comprising the step of providing means for providing random numeric designations being a pyramid shaped die having a predetermined array of numeric designations on each of its faces so that the position of said die resulting from a toss reveals the side of the game board adjacent to which said first set of playing pieces are to be set out.

15. The Method of claim 8 further comprising the step of providing each of said multi-planar levels of the game board having a different but uniform color so as to clearly indicate the level of play in each of said spaces of said game board.

16. The Method of claim 15 wherein the first color of the first side of said fill squares matches the second level of play of the game board and the second color of the second side of said fill squares matches the third level of play of said game board.

17. The Method of claim 8 wherein the restriction of movement between levels of the multi-planar game board for each playing piece occurs if the level of the game board differs by more than one level such that a playing piece's movement path is blocked and said playing piece may not move farther along the movement path.

18. The Method of claim 8 wherein the restriction of movement may further be accomplished by one player placing the Obstacle playing piece along the movement path of one of the opponent's playing pieces.

* * * * *